United States Patent [19]

Iwano

[11] 3,945,828

[45] Mar. 23, 1976

[54] ACTIVATION OF SILVER HALIDE PHOTOGRAPHIC DEVELOPERS

[75] Inventor: Haruhiko Iwano, Minami-ashigara, Japan

[73] Assignee: Fuji Photo Film Co., Ltd., Minami-ashigara, Japan

[22] Filed: Jan. 24, 1973

[21] Appl. No.: 326,227

[30] Foreign Application Priority Data

Jan. 29, 1972 Japan ..... 47-10666

[52] U.S. Cl. ..... 96/66 R; 96/50 A

[51] Int. Cl.[2] ..... G03C 5/26; G03C 5/30

[58] Field of Search ..... 96/66 R, 48 PD, 60, 50 A

[56] References Cited

UNITED STATES PATENTS 3,645,736 2/1972 Mowat ..... 96/60 R 3,723,126 3/1973 Price ..... 96/61 M

OTHER PUBLICATIONS

Photo Sci. Eng., 13(2), pp. 38–44, 1969, Jonker.

Chem. Absts., Vol. 11, 1917, p. 1093.

Chem. Absts., Vol. 71, p. 55891n.

Chem. Absts., Vol. 74, p. 26650q.

Chem. Absts., Vol. 76, p. 52924t.

*Primary Examiner*—Mary F. Kelley

*Attorney, Agent, or Firm*—Sughrue, Rothwell, Mion & Zinn

[57] ABSTRACT

A method of activating a photographic developer which comprises contacting the photographic developer, which contains a metal capable of reducing an exposed silver halide as a developing agent, with a metal the same as the metal as the developing agent.

10 Claims, No Drawings

ACTIVATION OF SILVER HALIDE PHOTOGRAPHIC DEVELOPERS

BACKGROUND OF THE INVENTION

1. Field of the Invention

This invention relates to a method of activating a silver halide photographic developer using a metal salt as a developing agent.

2. Description of the Prior Art

Commonly used developers for silver halide photographic light-sensitive materials are an aqueous alkaline solution of an organic compound such as a 3-pyrazolidone, a p-aminophenol derivative, a p-phenylenediamine derivative or hydroquinone as a developing agent, and, as is well known from the literature, an inorganic metal having a reducing property for exposed silver halide grains can be used as a developing agent but, in practice, is seldom used.

The reason for the non-use of such inorganic metals is that an organic developing agent as described above reduces a silver salt during developing and, thereafter changes into a relatively stable oxidation product which has no influence upon the reaction system, whereby the reduction potential of the developer remains stable and at a sufficiently active level, while an inorganic metal developing agent changes during development or during storage into a high valency metal which tends to change reversibly into a low valency metal, whereby the oxidation-reduction potential of the developer changes with an increase in the amount of materials developed, and cannot be kept at an active level.

Therefore, in order to maintain a stable active level using an inorganic metal as a developing agent, development must be carried out while electrolytically reducing the high valency metal formed in the developing reaction or uneconomical procedures must be taken such as using a large quantity of supplemental developing solution or throwing away the developer after use. However, such inorganic metal developing agents do have advantages in that they can be used in an acidic or neutral solution and the concentration of the developing agent can be raised, so it is very important to establish an economical method for using such solutions.

SUMMARY OF THE INVENTION

It is thus one object of the invention to establish a new development method wherein an inorganic metal developer which exhibits lowered activity is activated, thereby regenerating the developing capacity and decreasing the quantity of developer required.

It is another object of the invention to make it possible to carry out an economical development in stable manner for long periods of time by using such a method.

In accordance with the invention, there is provided a method of activating a developer, which comprises adding to a silver halide photographic developer containing a metal capable of reducing exposed silver halide as a developing agent a compound of the same metal as the metal present as a salt, or more preferably, adding additional amounts of the metal per se, said metal having a large contact area, for example, in powdered, granular, wooly or sponge form.

DETAILED DESCRIPTION OF THE INVENTION

The silver halides to which the developer of the invention can be applied show the well-known form of commonly used silver halide photographic light-sensitive materials, e.g., to a material capable of holding a coating in layer form (support member) such as baryta paper or plastic film there is coated an aqueous solution of a water-soluble film-forming material such as gelatin, polyvinyl alcohol or polyvinylpyrolidone in which fine grains of a non-exposed silver halide (which do not form developing nuclei) are dispersed (photographic emulsion), and then dried in layer form.

At present, there are miscellaneous silver halide photographic materials differing in the variety and shape of the support, composition of the coating solution, variety and grain size of the silver halide, additives in the coating solution and the construction of coating layer and support, depending upon the exact use of the material. The developer of the invention is applicable to any of these light-sensitive materials, e.g., the method of the invention can be applied to all photographic material such as in a black and white developer including a first developer in a color reversal process.

In the developer of the present invention there is contained a metal capable of reducing exposed silver halide as a developing agent. The preferred metals used for this purpose are the lower valency transition metals which have an oxidation-reduction (redox) potential lower than that of silver. Specific examples of useful metals include titanium, iron, vanadium, cobalt and nickel.

These metals can, of course be introduced into the developing solution as a salt and, in fact, this is the usual method of introduction. Illustrative of metals used are the lower valency transition metals or complex salts thereof, "lower valency" meaning the lower of two or more valence states such as $Fe^{++}$ and $Fe^{+++}$. Examples of lower valency metal salts are titanium trichloride, vanadium sulfate, ferrous oxalate, ferrous sulfate, titanium tribromide, titanium triiodide, vanadium trichloride, ferrous chloride and ferrous bromide.

The compounds of the following formulae (I) and (II) are illustrative of ligands which form a complex compound with a lower valency metal ion such as $Fe^{++}$ or $Ti^{+++}$:

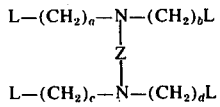

(I)

In this formula, L is —COOM or

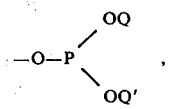

M is H, Na, K, Li, $NH_4$ or a substituted ammonium group such as a trialkanol or trialkyl ammonium group where the alkanol or alkyl group has 1 to 4 carbon atoms such as a triethyl ammonium group or a trialkanol ammonium group, Q and Q' are H, Na, K, Li, $NH_4$, a substituted ammonium group such as a trialkanol or trialkyl ammonium group where the alkanol or alkyl group has 1 to 4 carbon atoms such as a triethyl ammonium group or a trialkanol ammonium group alkul or aralkyl, *a*, *b*, *c* and *d* are 1, 2 or 3, Z is a divalent group such as a phenylene group (o- or p-), a cyclohexylene group or

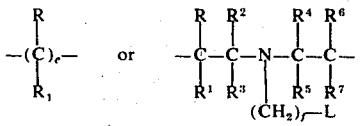

where R, $R^1$, $R^2$, $R^3$, $R^4$, $R^5$, $R^6$ and $R^7$ are H, OH, $NH_2$, a substituted amino group such as a $C_1$–$C_4$ trialkanol or trialkyl amine, e.g., triethanoamine or triethylamine, halogen, alkyl or alkoxy of four or less carbon atoms, $C_4$, *f* is 0, 1, 2 or 3 and *e* is 1, 2 or 3.

In the above formulae all alkyl groups, including those present in an aralkyl or alkoxy group, preferably have 1 to 4 carbon atoms and the aralkyl group includes both mono- and polyaryl groups.

Specific examples of compounds represented by the above formulae are:

1. ethylenediaminetetraacetic acid
2. diethylenetriaminepentaacetic acid
3. ethylenediamine-N,N,N′,N′-tetramethylenephosphoric acid
4. 1,3-diaminopropanol-N,N,N′,N′-tetramethylenephosphoric acid
5. 1,2-cyclohexanediamine-N,N,N′,N′-tetramethylenephosphoric acid
6. 1,3-propanediamine-N,N,N′,N′-tetramethylenephosphoric acid
7. 1,6-hexanediamine-N,N,N′,N′-tetramethylenephosphoric acid
8. Li, Na, K or $NH_4$ salts of the above mentioned compounds

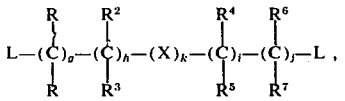

(II)

where R—$R_1$ are as described above. In this formula, X is a divalent group such as O or S or

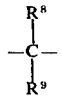

or >$NR^{10}$ in which $R^8$, $R^9$ and $R^{10}$ are H, alkyl (e.g., methyl, chloromethyl, hydroxyethyl, ethoxyethyl,-bromoethyl, propyl, butyl, cyclohexyl), aralkyl (benzyl, β-phenylethyl), alkoxy (methoxy, ethoxy, butoxy), phenyl, substituted phenyl group (tolyl) or —$(CH_2)_f$—L (where *f* and L are as defined in formula (I)), *g*, *h*, *i* and *j* are 0, 1, 2 or 3, and *k* is 0 or 1. The same material regarding preferred alkyl groups in formula (I) apply to formula (II).

Examples of the compounds represented by the above general formula are:

8. nitrilotriacetic acid
9. oxalic acid
10. malonic acid
11. chloromalonic acid
12. ethylmalonic acid
13. aminomalonic acid 14. succinic acid
15. glutamic acid
16. adipic acid
17. diglycolic acid
18. ethyliminodipropionic acid
19. ethylenedithioglycolic acid
20. thioglycolic acid
21. malic acid
22. tartaric acid
23. citric acid
24. nitrilo-N,N,N-trimethylenephosphoric acid
25. propylamino-N,N-dimethylenephosphoric acid
26. o-carboxyanilino-N,N-dimethylenephosphoric acid
27. o-acetamidobenzylamino-N,N-dimethylenephosphoric acid
28. o-toluidine-N,N-dimethylenephosphoric acid
29. 2-pyridylamine-N,N-dimethylenephosphoric acid
30. methylenediphosphoric acid etraethyl ester
31. cyclohexylmethylenediphosphoric acid
32. benzylidenephosphoric acid tetraethyl ester
33. methylenediphosphoric acid
34. tetraethylnonadecylidenephosphoric acid
35. Li, Na, K and $NH_4$ salts of the above mentioned compounds Ligand materials which can be used include polycarboxylic acids such as citric acid for ferrous ions.

Useful compounds and metals as can be used in the present invention are summarized J. Willems: "Belgische Chemische Industrie" Vol. 21, page 325–358 (1956) and Vol. 23, page 1105–1115 (1958), "Photographic Processing Chemistry" by Mison (Focal Press), pages 173–176, in N. I. Kirillov: "Problems in Photographic Research (Focal Press)" page 65, page 134 (1967) and C. E. K. Mees and T. H. James: "The Theory of Photographic Process" (3rd Ed.) (The Macmillan Co. N.Y.) page 279–280 (1966) inorganic metal salts. All of these are incorporated by reference.

The developer may further contain known prehardeners and additives such as, for example, alkali halides, sodium sulfate, magnesium sulfate, sodium acetate, sodium nitrate, fog inhibitors such as 1-phenylmercaptotetrazole, 6-nitrobenzimidazole or benzotriazole, phosphates, borates, potassium alum and chrome alum. There may also be used as the prehardener one or more known aldehyde hardeners such as formaldehyde, glutaraldehyde, succinaldehyde, glyoxal, thiobisacetaldehyde, α-methylglutaraldehyde, β-methylglutaraldehyde, methylsuccinaldehyde, maleicdialdehyde and coutaraldehyde. These hardeners can be used in the form of an aldehyde or an adduct with a bisulfite, or in the form of a precursor such as dimethoxytetrahydrofuran.

The developer has a pH of 0.5 to 7, preferably 4 to 6. The concentration of metal developing agent in the developer of this kind is ordinarily within the range of 1–200 g/l when a ligand is not used, and 1–400 g/l when a chelate compound of a metal ion is used. A metal and a ligand can be added respectively within a concentration range of 1–200 g/l to thus form a chelate compound in the developer per se.

The feature of the invention resides in that a developer which is fatigued by development and which exhibits lowered activity is contacted with the same metal as that originally present in the developing agent, and thus the activity of the developer is recovered in a short time. Therefore, more light-sensitive materials can be handled with a certain quantity of developer where developer is disposed of after use, or the activated solution can be repeatedly used as a supplementary solution when carrying out development with the addition of make-up or supplementary developer. During or after use, the developer can be reacted with the complementary metal, e.g., metallic iron (woolly, powdered or granular) in the case of an iron or iron salt developer and with metallic titanium in the case of a titanium or titanium salt developer.

Contact with such metal may preferably be carried out by passing the developer through a filtering tank using as a filter a metal having a large contact area, for example, in powdered, granular, woolly or sponge form. Of course, other suitable methods may be employed such as by charging a piece of the metal into the developing tank. In some embodiments of the invention, a metal filtering tank is provided in the circulation system of a developing tank system, whereby the developer is activated through circulation to prevent it from lowering in activity during continuous development, and the overflow from a developing tank is passed through a filtering tank to regenerate the activity thereof and reuse the same as a supplementary solution, if necessary, after any desired concentration control.

Using the principle of activation as one embodiment of the application of the present invention, a lower valency metal salt developer can be produced from the corresponding higher valency metal salt having intrinsically no developing action. For example, a mixed aqueous solution of ferric sulfate and ethylenediaminetetraacetic acid capable of oxidizing and bleaching developed silver but which is not a developer per se can be converted into an active developer by the above mentioned iron treatment.

The following examples are to illustrate the invention in greater detail without limiting the same.

EXAMPLE 1

An oxidizing solution having the following composition was prepared:

| | |
|---|---|
| ferric sulfate | 10 g |
| disodium ethylenediaminetetraacetate (dihydrate) | 36 g |
| sodium carbonate (monohydrate) | 10 g |
| boric acid | 10 g |
| water to make 1000 ml | |

This solution had no developing capacity. To this solution was added 5 g of commercially available metallic iron powder, the mixture stirred and the precipitate filtered. The resulting solution blackened an exposed silver halide, but gradually lost developing capacity when allowed to stand. However, the developing activity of the solution was recovered by treatment again with metallic iron powder as described.

EXAMPLE 2

Similar results were obtained by repeating the procedure of Example 1 but using 30 g of nitrilotriacetic acid per 1000 ml in place of the 36 g of disodium ethylenediaminetetraacetate dihydrate.

EXAMPLE 3

A continuous treatment with an iron (II)-EDTA developer was carried out using a small developing machine. A black-and-white positive film (fine grain positive movie film made by Fuji Photo Film Co.) was exposed and then continuously treated with a black-and-white developer having the following composition by means of the small developing machine. The residence time of the film in the developing tank was 2 minutes and 45 seconds and the temperature was 27°C. This developing tank had a capacity of 3.5 l and a circulation system wherein the developer was guided via a pipe to a temperature control section from the upper portion of the tank and then returned via a small pump to the developing tank from a feed port at the lower portion of the developing tank.

| | Composition of developer | |
|---|---|---|
| Solution A | | |
| | ammonia water (sp. gr. 0.91) | 50 ml |
| | disodium ethylenediaminetetraacetate (dihydrate) | 140 g |
| | water to make 1000 ml | |
| Solution B | | |
| | ferrous sulfate | 100 g |
| | water to make 300 ml | |

At the time of use, solutions A and B were mixed. During development, a supplementary solution having the same composition as the above described developer (tank solution) was supplemented at a rate of 35 ml per 1 minute to prevent quality deterioration.

A cartridge filled with steel wool was then fitted to the circulation section of the developing tank so that the developer was passed through the cartridge, contacted the steel wool and returned to the developing tank. The cartridge was cylindrical and filled with 1 kg of steel wool. The developer was pumped to the bottom and delivered from the upper portion of the cartridge. The inner volume of the cartridge was about 2000 ml and the flow rate of developer was 1000 ml/min. The quantity of the supplementary solution could be reduced to ⅓ of the above value by the provision of the cartridge. The composition of the supplementary solution used was free of iron salt, as shown below:

| Composition of supplementary solution | |
|---|---|
| ammonia water (sp. gr. 0.91) | 30 ml |
| disodium ethylenediamintetraacetate (dihydrate) | 140 g |
| water to make 1000 ml | |

In accordance with the method of this invention, the quantity of developer used can largely be reduced and a stable development can be carried out for a long time. Moreover, the photograhic qualities compare favourably with those of prior art processes.

EXAMPLE 4

A reversal color film of the multi-layer type containing a cyan coupler in a red-sensitive layer, a magenta coupler in a green-sensitive layer and a yellow coupler in a blue-sensitive layer was exposed and then subjected to reversal color development using a hardening developer having the following composition for the first development:

| | |
|---|---|
| titanium trichloride | 20 g |
| tetrasodium ethylenediaminetetraacetate | 70 g |
| formalin (37 wt %) | 14 ml |
| succinaldehyde | 6 g |
| KBr | 2 g |
| pH | 4.2 |

-continued water to make 1000 ml

After hardening development at 38°C for 3 minutes, the steps of neutralization, color forming development, stopping, water washing, bleaching, fixing, water washing and stabilizing were carried out in the recited order, thus obtaining a reversal image.

Since the life of this hardening developer was short, the developing capacity lowered after one day, and only a low sensitivity image having a high density at high light areas was obtained. However, the activity of the solution was recovered by adding 0.5 g of metallic titanium per 1000 ml of the low activity solution.

While the invention has been described in detail and with reference to specific embodiments thereof, it will be apparent to one skilled in the art that various changes and modifications can be made therein without departing from the spirit and scope thereof.

What is claimed is:

1. A method of activating a photographic developer of reduced activity which contains a lower valence metal capable of reducing exposed silver halide as a developing agent, said metal being present in combination with a ligand, which forms a complex with the metal, of the following formula:

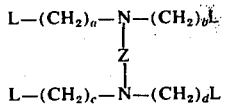

wherein L is —COOM or

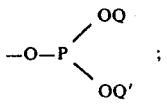

M is H, Na, K, Li, $NH_4$ or a substituted ammonium group such as a trialkanol or trialkyl ammonium group where the alkanol or alkyl group has 1 to 4 carbon atoms; Q and Q′ are H, Na, K, Li, $NH_4$, a substituted ammonium group such as a trialkanol or trialkyl ammonium group where the alkanol or alkyl group has 1 to 4 carbon atoms or aralkyl; *a*, *b*, *c* and *d* are 1, 2, or 3; Z is a divalent group such as a phenylene group, a cyclohexyl group,

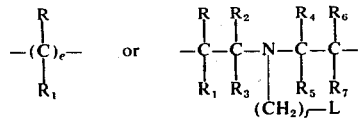

wherein L is described above; R, $R_1$, $R_2$, $R_3$, $R_4$, $R_5$, $R_6$ and $R_7$ are H, OH, $NH_2$, a substituted amino group such as a $C_1 - C_4$ trialkanol or trialkyl amine, halogen, alkyl or alkoxy having 1–4 carbon atoms; *f* is 0, 1, 2 or 3; *e* is 1, 2 or 3; said developing agent initially being present in an amount sufficient to reduce exposed silver halide, said method comprising contacting said photograhic developer with a metal the same as the metal of the developing agent and having a large contact area.

2. The method of claim 1 wherein the metal is a metal having an oxidation-reduction potential lower than silver.

3. The method of claim 1 wherein the metal is iron, titanium, vanadium, cobalt or nickel.

4. The method of claim 2 wherein the developer has a pH of 0.5 to 7.

5. The method of claim 4 wherein the concentration of metal in the developer is from 1–200 g/l.

6. The method of claim 1 wherein the metal exhibits at least two valence states and as an active developer is in the lower valence state.

7. The method of claim 1 wherein the metal and ligand are each present in the developer in an amount of 1 to 200 g/l, whereby a chelate is formed in the developer.

8. The method of claim 1 wherein the activation is continuous and metal is introduced into the developer in an amount equivalent to that consumed in the photographic development.

9. The method of claim 1 wherein the activation is conducted in a batch-wise manner.

10. The method of claim 1 wherein said ligand is ethylenediaminetetraacetic acid or a salt thereof.

* * * * *